US006146757A

United States Patent [19]

Mor et al.

[11] Patent Number: 6,146,757

[45] Date of Patent: Nov. 14, 2000

[54] WETTABLE POLYMER FIBERS, COMPOSITIONS FOR PREPARAING SAME AND ARTICLES MADE THEREFROM

[75] Inventors: Ebrahim Mor, Laguna Niguel, Calif.; Vasanthakumar Narayanan, Knoxville, Tenn.

[73] Assignee: Techmer PM, Rancho Dominguez, Calif.

[21] Appl. No.: 09/106,998

[22] Filed: Jun. 29, 1998

[51] Int. Cl.[7] ..... D01F 6/00; D01F 8/00

[52] U.S. Cl. ..... 428/364; 428/373

[58] Field of Search ..... 428/364, 373, 428/374; 523/125

[56] References Cited

U.S. PATENT DOCUMENTS

| | | | |
|---|---|---|---|
| 2,462,331 | 2/1949 | Myers . | |
| 3,048,263 | 8/1962 | Sacks et al. . | |
| 3,048,266 | 8/1962 | Hackhel et al. . | |
| 3,285,855 | 11/1966 | Dexter . | |
| 3,644,482 | 2/1972 | Dexter et al. . | |
| 3,847,676 | 11/1974 | Palmer et al. . | |
| 3,867,324 | 2/1975 | Clendinning et al. . | |
| 3,929,509 | 12/1975 | Taskier . | |
| 3,973,068 | 8/1976 | Weber . | |
| 4,070,218 | 1/1978 | Weber . | |
| 4,073,852 | 2/1978 | Mesek . | |
| 4,076,698 | 2/1978 | Anderson et al. . | |
| 4,181,762 | 1/1980 | Benedyk . | |
| 4,189,420 | 2/1980 | Sugimoto et al. . | |
| 4,258,097 | 3/1981 | Benedyk . | |
| 4,273,802 | 6/1981 | Kamada et al. . | |
| 4,273,892 | 6/1981 | Rave . | |
| 4,274,971 | 6/1981 | Hartinger et al. . | |
| 4,307,143 | 12/1981 | Meitner . | |
| 4,356,220 | 10/1982 | Benedyk . | |
| 4,578,414 | 3/1986 | Sawyer et al. | 524/310 |
| 4,581,397 | 4/1986 | Witman . | |
| 4,764,567 | 8/1988 | Ott . | |
| 4,857,251 | 8/1989 | Nohr et al. . | |
| 4,906,687 | 3/1990 | Modic . | |
| 4,923,914 | 5/1990 | Nohr et al. . | |
| 5,045,387 | 9/1991 | Sehmalz | 428/375 |
| 5,096,939 | 3/1992 | Mor | 523/125 |
| 5,096,940 | 3/1992 | Mor | 523/125 |
| 5,582,904 | 12/1996 | Harrington | 428/373 |

OTHER PUBLICATIONS

Product Bulletin, *Escorene Polypropylene PP3546G Ultra-High Melt Flow Rate Fiber Grade*, Sep. 1996.

Technical Bulletin, *T–DET Surfactants, T–DET N–4*, Jun. 1995.

Product Specification, *SILWET L–7604*, Jan. 1, 1996.

Product Bulletin, *Amoco Polypropylene, Homopolymer Resin Grade 7956*, faxed Aug. 3, 1993.

*Primary Examiner*—N. Edwards

*Attorney, Agent, or Firm*—A. M. (Andy) Arismendi, Jr.

[57] ABSTRACT

The invention is directed to wettable fibers or filament having a thermoplastic polymer, a first wetting agent, and a second wetting agent.

26 Claims, No Drawings

WETTABLE POLYMER FIBERS, COMPOSITIONS FOR PREPARAING SAME AND ARTICLES MADE THEREFROM

FIELD OF THE INVENTION

The present invention is directed to wettable fibers and filaments of synthetic polymers, compositions for preparing same, and articles made therefrom.

BACKGROUND

There are many thermoplastic polymers which can be made into fibers and filaments. Of particular interest are polyolefins which include polyethylene, polypropylene, polybutene, polypentene, and ethylene and propylene copolymerized with other olefinic monomers such as higher olefins and conjugated dienes. Olefin polymers are known for their hydrophobic properties. Therefore, wettability of such polymers, including those in fibrous or filament form, is achieved by means of wetting agents provided in, or on, the polymer fibers or filaments.

Such fibers or filaments are useful in producing battery separators (e.g., U.S. Pat. No. 3,847,676); disposable absorbent products such as diapers, feminine care products, incontinence products and the like (e.g. U.S. Pat. No. 4,073,852 and U.S. Pat. No. 4,923,914); wiper materials (e.g., U.S. Pat. No. 4,307,143); papers (e.g. U.S. Pat. No. 4,273,892); and filter aids (e.g., U.S. Pat. No. 4,274,971).

Synthetic fibers are produced as continuous filaments by a process known as melt spinning. Plastic pellets are fed in to a hopper and melted in a single screw extruder. The molten polymer is then filtered and metered before being forced through a spinerette that contains thousands of small holes to form fibers. The fibers are then solidified by coming into contact with air as they are drawn by the rollers of sequentially increasing speeds. The drawn fibers are then wound onto spools. The spools are made into bunches called tows and cut into staple fibers according to the manufacturer's requirements.

Fibers are the main constituents of fabrics and nonwovens. Nonwovens are unconventional textile assemblies that are obtained by processes other than weaving. In recent years, there has been is a phenomenal growth in the usage of nonwovens in personal hygiene, diapers, adult incontinence, medical, construction, geotextiles and automotive applications. Nonwovens are made from both natural and synthetic fibers and a combination of both. Usually, the fibers are obtained or extruded and bonded into thin sheets by heat or mechanical or chemical means. The main types of nonwovens used in the market includes spunbonded and melt blown type. The details of these types of materials and their manufacture will be explained in the following paragraphs. Very often, more than one type of nonwoven is used to make laminates or composite structures. The nonwovens are sometimes further bonded to provide them with adequate strength for other operations.

In the manufacture of a spunbond nonwoven, polymer chips are fed through the hopper and melted in the single screw extruder. Some machines also have side feeder capability to feed various additives. The molten polymer is metered and then forced into fine continuous filaments through several thousand spinnerette holes to form continuous filaments. The filaments are drawn and entangled through the action of venturi and deposited on a collection belt. The unbonded, entangled fibers are passed through two heated calendar rolls for thermal bonding of the fibers to each other at points of contact. The nonwoven fabric is then wound and shipped to converting applications where the fabric is made into final products. Alternatively or in addition, the fibers may be bonded through needle-punching and chemical bonding. The polymers typically used in spunbonding are polyolefins, such as polyethylene and polypropylene; polyamides; and polyesters. Polypropylene is most commonly used with a melt flow rate in the range between 30–40. Polypropylene is easy to process and cost-effective when compared to other polymers. Spunbond polypropylene nonwovens are used in baby diapers, napkins, feminine hygiene products, laminates, adult incontinence, medical garments, agricultural covers, etc.

In the manufacture of a melt blown nonwoven, polymer chips are fed through a hopper and melted in a single screw extruder. Some machines have additional side feeding capacity for additives. The molten polymer is forced through very fine die holes that are situated either vertically or horizontally to form fibers. The fibers are then subjected to the action of very hot air at very high velocities which results in fibers with sub-micron diameters. The fibers are bonded to each other at contact points as they cool down. Usually, there is no separate bonding process. Melt blown products are used in filters, wipes, battery separators, and insulators.

The use of surfactants in textile fibers is well known. For instance, the surfactants have been used as spin finish to provide cohesion between synthetic fibers before drawing and texturing. This also reduces the friction between the rollers and fibers preventing abrasion of rollers and breakage of the fibers. Surfactants are also added to the finished fiber goods to impart the desired finish, for example, hydrophilic, hydrophobic, or oil repellant. The surfactants could be cationic (quaternary ammonium compounds), anionic (phosphates, sulfates) or non-ionic (esters, alcohols, ethoxylates, etc.).

However, their use has been mainly through topical surface coating treatments such as spraying, coating, padding, etc. A similar approach has been used conventionally in woven or knitted fabrics and nonwovens. Surface coating applications have a number of disadvantages including the following: 1) throughput is reduced and more floor space is required; 2) when spraying is involved, the over spray and the spills are environmental concerns; 3) the coating is not usually well-bonded to the fiber and may be partially lost during storage or in subsequent operations; and 4) there are always some quality control issues, for example, the uniformity of the coating. Examples of such methods and products are discussed below.

U.S. Pat. No. 3,929,509 (according to U.S. Pat. No. 4,923,914) discloses a hydrophilic microporous film which is useful as a battery separator. The film comprises a hydrophobic microporous film coated with a silicone glycol copolymer surfactant. In a preferred embodiment, the surfactant coating comprises a mixture of a silicone glycol copolymer surfactant and a second surfactant which preferably is an imidazoline tertiary amine. The silicone glycol copolymer surfactant preferably is a polyoxyethylene polydimethylsiloxane.

U.S. Pat. No. 4,307,143 discloses, inter alia, a wipe made of meltblown microfiber webs which have been sprayed with a wetting agent as the web was formed. The fibers exemplified were of polypropylene and of polyethylene terephthalate polyester. The wetting agents disclosed were dioctylester of sodium sulfosuccinic acid (exemplified) and isooctyl phenylpolyethoxy ethanol (not exemplified).

Recent advances in this area have been to incorporate the additives in the melt state in attempts to form a melt-stable formulation. One such additive is the use of melt blendable surfactants in forming hydrophilic nonwovens or fibers. The melting point or molecular weight of the additive determines its processability during its incorporation into polymers and the processability at the spinning or blowing stage. The lower the molecular weight, the lower the viscosity and this governs the amount of liquid that can be incorporated. Two things to keep in mind while melt blending and using the melt blended concentrate for final goods manufacturing are incorporation and migration characteristics: 1) incorporation at the melt state depends on the solubility of the additive with melt, additive- and polymer-type, chemistry, polarity, molecular weight, melting point, etc.; and 2) migration of the additives to the surface depends on the diffusion characteristics of the additive in the solid state, molecular weight, structure, purity, etc.

As long as the above mentioned parameters are carefully selected for a particular application, one will be able to achieve the right type of surface modification and additive incorporation. However, this is typically easier said than done. Substantial effort has been expended to achieve such properties and improvements as evidenced by the patents in this area. Along this line, various types of additives and their mixing with different types of polymers in the melt stage have been provided in the previous arts.

U.S. Pat. No. 3,048,266 discloses, inter alia, a polyolefin film containing an anti-fog agent, which is a particular ester or ether of ethylene oxide. The anti-fog additive is preferably incorporated in the polyolefin material rather than sprayed on.

U.S. Pat. No. 4,578,414 discloses an olefin polymer, preferably a linear low density polyethylene copolymer (LLDPE), having compounded therewith a wetting agent, which is used in forming wettable fibers and/or filaments. The wetting agent has at least one of the following: (1) an alkoxylated alkyl phenol along with a mixed mono-, di- and/or tri-glyceride, or (2) a polyoxyalkylene fatty acid ester, or (3) a combination of (2) and any part of (1).

U.S. Pat. No. 4,923,914 discloses, inter alia, a thermoplastic composition containing a thermoplastic polyolefin and an additive which is a siloxane-containing compound. During the processing of the composition as the thermoplastic polyolefin cools down, there is a segregation of the additive towards, for instance, the surface of the fiber as the polymer gradually solidifies. One such compound is identified therein as being commercially available as SILWET L-7602 from Union Carbide. (See Column 22, lines 62–63 thereof). These compositions may be used to form nonwovens according to the methods of U.S. Pat. No. 4,857,251, which also identifies SILWET L-7602 (See Column 23, lines 59–60).

However, to date, the efficacy of these surfactants is generally limited by their poor wettability and durability. Generally, wetting agents having high wettability are readily washed from the fiber exactly because of the wetting agent's hydrophilic characteristics.

An attempt to provide hydrophilic polypropylene fibers having an improved balance of wettability and durability is disclosed in U.S. Pat. No. 3,847,676 relating to battery separators. This patent discloses the use of an internal melt blendable surfactant having moderate wetting action so that it will not easily be removed, thus having higher wetting action producing durable, hydrophilic fibers. Particularly preferred internal surfactants were $C_8$ and $C_{18}$ phenol surfactants having 1 to 15 moles of ethylene oxide, more preferably 1 to 6 moles of ethylene oxide and most preferably 1 to 3 moles of ethylene oxide. These surfactants are relatively water insoluble. However, because of the limited wetting action of the internal surfactant, a second surfactant used as an external surfactant was coated on the surface of the fibers in order to enhance the hydrophilic performance of the fibers. The external surfactants are relatively water soluble. In Example 1 thereof, the internal surfactant was nonyl phenol ethylene oxide containing 4 moles of ethylene oxide; and the external surfactant was a mixture in equal parts of Triton X-100 (an isooctyl phenyl polyethoxy ethanol per U.S. Pat. No. 4,307,143) and dioctyl ester of sodium sulfosuccinic acid. This two-step method is generally complex and expensive, limited by the same problems associated with the surface coating of wetting agents and which were described earlier.

Further, a fine point that is missing is the identification of cost-effective formulation of the concentrates or master batches and the way to commercially produce them. As mentioned previously, there is a critical limit on the amount of additive that can be incorporated which depends on the type of additive, type of polymer and the type of equipment employed to produce a commercially viable concentrate that can cater to the commodity goods market.

Along this line, surfactants have also been blended with the plastic at the melt stage at higher concentrations than that in the final article. This material is then cooled and sold in the form of pellets known as additive concentrates or master batches. The use of a master batch in fiber spinning, nonwoven manufacturing and other related processes to modify the surface is dependent on the final application, migration of the material to the surface, polymer and additive characteristics, process environment and cost. The nonwovens industry that supplies the diaper and hygiene markets has always been on the look-out for a cost-effective additive formulation that is durable and with high re-wet characteristics.

More often, depending on the application, the manufacturers of thermoplastic fibers and nonwoven manufacturers are confronted with the production of hydrophilic materials that should have a high degree of durability during storage, washing, dyeing, finishing and in end use applications. Natural fibers such as cotton and viscose rayon have excellent water absorbing capabilities but retain moisture for a long period of time. Cotton fibers can pickup as much as 8% by weight water and viscose rayon twice that amount. In cotton, the exceptional water-uptake can be attributed to the presence of three hydroxyl (—OH) groups. Also, the amorphous regions in the fibers are believed to be primarily responsible for water or dye-uptake. The fabrics are usually not compact and the fibers wither away during usage, especially in hostile environments such as acids or alkalis. The invention of synthetic fibers such as polyamide (nylon) and polyester in the 1960's has resulted in the production of fibers where required properties could be tailor-made. These fibers can be considered as moderately hydrophilic. Nylon has a water regain of about 4% by weight and polyester of about 0.4% by weight. Moreover, the presence of functional groups, i.e., —C(O)—N(H)— in nylon and —C(O)—O— in polyester can be exploited in dyeing with acidic or basic dyes. The same groups are responsible for their water absorption characteristics. These fibers have better environmental resistance when compared to the natural fibers. However, they also degrade over a period of time when exposed to acidic or alkaline environments.

The solution for this problem has been to use fibers made from addition polymers such as polyolefins. Among the polyolefin polymers, polypropylene is the most widely used because it is cheap and has ideal rheological characteristics essential for fiber formation with high crystallinity. Thus, fibers made from polypropylene polymer have been replacing natural and other synthetic fibers for economical, property and processing reasons. However, in situations where hydrophilicity is needed, the surface of polyolefin polymers must be modified or altered through the use of wetting agents.

Finishing operations during textile processing permits the surface and even some times the bulk of the material to be modified to make soft, hydrophilic, hydrophobic and oil repellent goods. However, the surfactants used are usually only mechanically applied and hence get washed or wiped away during further processing, usage or storage. This effect is especially severe in the case of a non-polar, hydrophobic polymers such as polyolefins where the interaction between the surfactants and the polymer is minimal. The surfactant is usually a liquid, gel or a solid that is usually formed into a solution that is then applied onto the polymer. Water or alcohol can be used to form the solution. The solution is applied through spraying or padding, and is then dried. This is a labor and energy intensive process which results in significant loss of surfactants and potential environmental problems. More recently, the liquid or solid additives were melt blended with plastics that can be directly extruded into films, filaments, fabrics or nonwovens. The surfactants are usually loaded at a much higher concentration in the plastic using a special process where sometimes, the liquid is injected into molten polymer and extruded. This concentrate is used at a certain percent by weight by the end use manufacturers to achieve the desired properties.

The use of melt blendable additives is to delay the loss of the surface active agents. The polymer acts as a reservoir for the additives that get pushed to the surface of the final part during the slow recrystallization process. Theoretically, the use of surfactants that are in liquid form in the melt form a separate phase within and on the surface of the polymer. This and the incompatibility of the part of the surfactants pushes the low molecular weight additives to the surface. This phenomenon is dependent on the type of alkyl chain that is miscible with the plastic, the molecular weight of the additive that determines processability, stability and migration and the type of polymer itself.

Therefore, a need exists for wetting agents which resist migration and transference, but provide wettable fibers or filaments which do not require aging, and are easily incorporated and commercially viable. In other words, to date, a need remains for more durable, hydrophilic compositions for fibers which are easy and economic to use.

SUMMARY OF THE INVENTION

Accordingly, there is provided wettable fibers or filaments from a composition comprising a thermoplastic polymer having incorporated therein a first wetting agent and a second wetting agent, wherein the thermoplastic polymer is preferably selected from the group consisting of olefin polymers, more preferably ethylenically saturated olefin polymers, and wherein the first wetting agent is at least one water-insoluble, nonionic alkoxylated alkylphenol and wherein the second wetting agent is at least one compound selected from the group consisting of an alkoxylated fatty alcohol and a water-soluble, nonionic, non-hydrolyzable polyoxyalkylene-modified organosilicone polymer.

As stated above, the thermoplastic polymer is preferably an olefin polymer and more preferably an ethylenically saturated olefin polymer. The olefin polymer may be a homopolymer of propylene or ethylene or copolymer of propylene and/or ethylene. The olefin polymer is preferably polypropylene, linear low density polyethylene (LLDPE), low density polyethylene (LDPE) and high density polyethylene (HDPE), more preferably polypropylene.

The alkoxylated alkylphenol is preferably an ethoxylated alkylphenol having an alkyl group with 8 to 22 carbon atoms and on average about 1 to about 10 moles of ethylene oxide per mole of the alkylphenol condensed thereon, i.e., having on average from about 1 to about 10 —$CH_2CH_2O$— groups per molecule of ethoxylated alkylphenol, more preferably from about 2 to about 8 moles of ethylene oxide condensed thereon, and most preferably from about 3 to about 6 moles of ethylene oxide condensed thereon. The ethoxylated alkylphenol preferably has the structural formula:

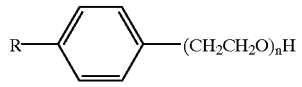

wherein n is a number from about 1 to about 10, preferably from about 2 to about 8, more preferably from about 3 to about 6, and R is an alkyl group having from about 8 to about 22 carbons atoms. R is preferably a nonyl group. It will be understood that the numerical value n may represent an average value as the length of the polyalkoxy chain can vary somewhat from molecule to molecule. In the structure shown above, the polyalkoxy chain is shown as a polyethoxy chain.

The alkoxylated fatty alcohol has from about 8 to about 22 carbon atoms and on average about 1 to about 100 moles of ethylene oxide per mole of alkoxylated fatty alcohol condensed thereon, i.e., having on average from about 1 to about 100 —$CH_2CH_2O$— groups per molecule of ethoxylated fatty alcohol, more preferably from about 2 to about 10 moles of ethylene oxide condensed thereon, and most preferably from about 3 to about 6 moles of ethylene oxide condensed thereon. The alkoxylated fatty alcohol is preferably an ethoxylated fatty alcohol. The fatty alkyl group thereof is preferably straight chained. In a preferred embodiment, the alkoxylated fatty alcohol is a combination of an ethoxylated cetyl alcohol and an ethoxylated stearyl alcohol in a weight ratio of from about 3:1 to about 1:3 of the ethoxylated cetyl to stearyl alcohols.

The polyalkylene-modified organosilicone compound is preferably a polysiloxane compound, which has a molecular weight ranging from about 600 to about 30,000, preferably from about 3,000 to about 10,000, and an HLB from about 5 to about 17, preferably from about 13 to about 17. The base compound is preferably a polydimethysiloxane. The polysiloxane is preferably modified by grafting polyethers thereto through a hydrosilation reaction resulting in polyalkylene oxide groups being attached along the siloxane backbone. Generally, these modified compounds have the following formula:

$$(R^1)_3SiO—(—Si(R^1)_2—O—)_X—(—Si(R^1)(R^2)—O—)_Y—Si—(R^1)_3$$

wherein each $R^1$ is independently monovalent alkyl group having from 1 to about 4 carbon atoms, preferably a methyl group;

$R^2$ is a group having the formula —$(CH_2)_3$—O—$(EO)_M(PO)_NR^3$, wherein

EO is an ethyleneoxy group,

PO is a 1,2-propyleneoxy group, and $R^3$ is hydrogen or an alkyl having from 1 to about 4 carbon atoms; and M, X and Y are numbers which have a value of at least 1, and N is a number which may be 0 or greater, wherein M, N, X and Y indicate only indicate the quantity of the respective group present in the compound without indicating or requiring, in instances where they are greater than 1, that such plurality of the respective group are connected to one another to form an oligomer or polymer.

The polymer formulations of the present invention for preparing the fibers or filaments preferably contain the first and second wetting agents in combination in the range of about 1 to about 20 percent by weight, more preferably from about 1 to about 15 percent by weight, based on the total weight of the polymer or polymers used.

In a preferred embodiment of the invention, the thermoplastic polymer is a polyethylene or polypropylene and the alkoxylated alkylphenol is an ethoxylated nonylphenol having on average from about 1 to about 10 moles of ethylene oxide condensed thereon. The nonylphenol ethoxylate preferably has the formula:

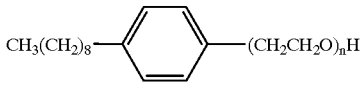

wherein n is a number from about 1 to about 10, preferably from about 2 to about 8, and more preferably from about 3 to about 6. The ethoxylated nonylphenol is preferably used in an amount from about 8 to about 12 percent by weight based on the total weight of the polymer. The water-soluble organosilicone compound is preferably a polyalkylene oxide modified polydimethylsiloxane (PDMS) having an average molecular weight ranging from about 3,000 to about 10,000 and has an HLB ranging from about 10 to about 17 in an amount of from about 0.5 to about 15 percent by weight of the weight of the thermoplastic polymer, which is preferably polyethylene or polypropylene.

There is also provided a concentrate having a thermoplastic polymer, for example, polypropylene homopolymer, containing a first and/or second wetting agent. For example, two separate concentrates may be made, each containing one of the wetting agents, and the concentrates combined, or let-down, with the desired thermoplastic polymer to the desired proportion of the respective wetting agent. Alternatively, if the relative proportions of the two wetting agents is to remain constant, a single concentrate may be prepared containing the first and second wetting agents and then let-down in the desired thermoplastic polymer. The concentrate is used in forming hydrophilic, smooth fibers and nonwovens with improved "textile-like" feel and elongation. The concentrate may have the respective type of wetting agent, i.e., a first or second wetting agent, at a concentration ranging from about 0.5 to about 60 percent by weight, preferably from about 20 to about 40 percent by weight, based on the weight of the thermoplastic polymer, noting that if more than one of a first or second wetting agent is used and the two or more first or second wetting agents, respectively, are combined in a single concentrate the concentration is for the combination of the first or second wetting agents and not each first or second wetting agent individually.

DETAILED DESCRIPTION OF THE INVENTION

Accordingly, there is provided wettable fibers or filaments from a composition comprising a thermoplastic polymer having incorporated therein a first wetting agent and a second wetting agent, wherein the thermoplastic polymer is preferably selected from the group consisting of olefin polymers, more preferably ethylenically saturated olefin polymers, and wherein the first wetting agent is at least one water-insoluble, nonionic alkoxylated alkylphenol and wherein the second wetting agent is at least one compound selected from the group consisting of a water-soluble, nonionic, non-hydrolyzable polyoxyalkylene-modified organosilicone polymer and an alkoxylated fatty alcohol.

The first and second wetting agent are selected to be thermally compatible with the thermoplastic polymer at the melt processing conditions. In this manner, the first and second wetting agents are available for incorporation into the thermoplastic polymer during melt processing, and are not decomposed, degraded or evolved under such processing conditions.

WETTING AGENTS

First Wetting Agent

The alkoxylated alkylphenol is relatively water-insoluble and is preferably an ethoxylated alkylphenol having an all group having from about 8 to about 22 carbon atoms and on average from about 1 to about 10 moles of ethylene oxide condensed thereon, i.e., having on average from about 1 to about 10 $—CH_2CH_2O—$ groups per ethoxylated alkylphenol, more preferably from about 2 to about 8 moles of ethylene oxide condensed thereon, and most preferably from about 3 to about 6 moles of ethylene oxide condensed thereon. The ethoxylated alkylphenol preferably has the structural formula:

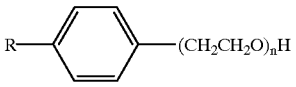

wherein n is a number from about 1 to about 10, preferably from about 2 to about 8, more preferably from about 3 to about 6, and R is an alkyl group having from about 8 to about 22 carbons atoms. It will be understood that the numerical value n may represent an average value as the length of the polyalkoxy chain can vary somewhat from molecule to molecule. In the structure shown above, the polyalkoxy chain is shown as a polyethoxy chain.

Second Wetting Agent

The polyalkylene-modified organosilicone compound is relatively water-soluble and is nonhydrolyzable, and is preferably a polyalkylene-modified polysiloxane. This compound has a molecular weight ranging from about 600 to about 30,000, preferably from about 3,000 to about 10,000, and an HLB from about 5 to about 17, preferably from about 13 to about 17. Examples of such modified polysiloxane compounds are disclosed in U.S. Pat. No. 4,923,914, which is hereby incorporated by reference in its entirety, and see for example, at column 21, line 28 through column 24, line 17, thereof. Prior to modification, the base compound is preferably a polydimethysiloxane.

The polysiloxane is preferably modified by grafting polyethers thereto through a hydrosilation reaction resulting in polyalkylene oxide groups being attached along the siloxane backbone. Generally, these modified compounds have the following formula:

$$(R^1)_3SiO—(—Si(R^1)_2—O—)_X—(—Si(R^1)(R^2)—O—)_Y—Si—(R^1)_3$$

wherein each $R^1$ is independently monovalent alkyl group having from 1 to about 4 carbon atoms, preferably a methyl group;

$R^2$ is a group having the formula $—(CH_2)_3—O—(EO)_M(PO)_NR^3$, wherein

EO is an ethyleneoxy group,

PO is a 1,2-propyleneoxy group, and $R^3$ is hydrogen or an alkyl having from 1 to about 4 carbon atoms; and M, X and Y are numbers which have a value of at least 1, and N is a number which may be 0 or greater, wherein M, N, X and Y indicate only indicate the quantity of the respective group present in the compound without indicating or requiring, in instances where they are greater than 1, that such plurality of the respective group are connected to one another to form an oligomer or polymer. X may range from 0 to about 100. Y may range from 1 to about 100. M may range from about 5 to about 25. N may range from 0 to about 25.

Alkoxylated fatty alcohols are obtained by attaching $—CH_2CH_2O—$ groups to a fatty alcohol, preferably through condensation chemistry. The alkoxylated fatty alcohols are preferably relatively water-soluble. Fatty alcohols are primary alcohols having from about 8 to about 20 carbons atoms, usually in a straight chain. High-molecular weight alcohols are produced synthetically by the Oxo and Ziegler processes. Those having from 8 to 11 carbon atoms are oily liquids; those having more than 11 carbon atoms are solids at room temperature. Other methods of production are (1) reduction of vegetable seed oils and their fatty acids with sodium, (2) catalytic hydrogenation at elevated temperatures and pressures, and (3) hydrolysis of spermaceti and sperm oil by saponification and vacuum fractional distillation. Examples of commercially available saturated fatty alcohols are octyl, decyl, lauryl, myristyl, cetyl, and stearyl alcohols. Examples of commercially available ethylenically unsaturated fatty alcohols are oleyl, linoleyl, and linolenyl.

In one embodiment, the alkoxylated fatty alcohols have the formula: $R—(PO)_T(EO)_PH$, wherein PO and EO are as previously defined, and T is a number ranging from 0 to about 100. P is a number ranging from about 1 to about 100. These may be prepared using conventional condensation chemistry. For example, the active hydrogen on the hydroxyl group of the fatty alcohol is the site where polyoxyalkylene blocks are added by oxyalkyalting (or as sometimes termed alkoxylating) same in the presence of a basic catalyst such as sodium, potassium or cesium hydroxide. Oxypropylating or propoxylating adds PO groups and oxyethylating or ethoxylating adds EO groups. See for example, U.S. Pat. No. 4,764,567, including background section thereof, hereby incorporated by reference. Preferred alkoxylated fatty alcohols are ethoxylated fatty alcohols having the formula $R—(CH_2CH_2O)_PH$, wherein R is an alkyl group having from about 8 to about 20 carbon atoms and wherein P is a number ranging from about 1 to about 100, more preferably about 2 to about 10.

THERMOPLASTIC POLYMERS

In general, the term "thermoplastic polymer" is used herein to mean any thermoplastic polymer which can be used in the preparation of fibers or films. A list of examples of such polymers is given in U.S. Pat. No. 4,923,914, which has already been incorporated by reference herein. The preferred thermoplastic polymers are polyolefins, with ethylenically saturated polyolefins being more preferred. Even more preferred are those polyolefins which contain only hydrogen and carbon atoms and which are prepared by addition polymerization of one or more unsaturated monomers.

Olefin Polymers

Typical organic polymeric materials contemplated include synthetic organic polymers and copolymers, especially including polyethylene, polypropylene, poly(1-butene), poly(4-methyl-1-pentene), ethylene-propylene copolymers, ethylene-1-butene copolymers, and ethylene-1-hexene copolymers, and homopolymers and copolymers of conjugated dienes monomers, copolymers of two or more conjugated dienes, and copolymers of a conjugated diene and another vinyl monomer, wherein the conjugated dienes are preferably ones containing from 4 to 8 carbon atoms, e.g., butadiene, isoprene and the like. See also, U.S. Pat. No. 4,578,414, which is hereby incorporated by reference. Preferred polymers include polyethylene, polypropylene, poly (4-methyl-1-pentene) and polystyrene.

OTHER ADDITIVES

The novel polymeric compositions of the present invention can also contain non-reactive additives. By the term "non-reactive additives," it is meant a modifying additive, filler or reinforcement commonly used in the formulation of polymeric compositions which does not materially interfere with the properties of the wetting agent in the composition. For example, the compositions of the invention may contain, in addition to the wetting agent and the polymer, such additives as dyes, pigments, and particulate fillers. In particular, the use of such particulate fillers as titanium dioxide, calcium carbonate, talc, clays, glass, and mica is contemplated.

Antioxidants and stabilizers may also be utilized in the polymeric compositions embodying the present invention. In some cases, it may be necessary to add an antioxidant or stabilizer to permit high temperature processing, even though such additive may have some adverse effects on the wettability of polymeric composition.

The preferred antioxidant for this purpose is a phosphite antioxidant available from Ciba-Geigy as IRGAFOS 168. Another suitable antioxidant is tetrakis[methylene(3,5-di-tert-butyl-4-hydroxy-hydrocinnamate)] methane. This composition is sold as IRGANOX 1010 by Ciba-Geigy and disclosed by U.S. Pat. Nos. 3,285,855 and 3,644,482, which are hereby incorporated by reference. Other suitable antioxidants are disclosed in U.S. Pat. No. 3,867,324, which is hereby incorporated by reference. The antioxidant(s) is used in a total amount of about 0.001 to about 0.05 percent by weight of the plastic composition.

PREPARATION OF COMPOSITION

The novel plastic compositions embodying the present invention are prepared by a number of methods. The novel plastic compositions can be compounded according to any one of several known techniques such as direct addition of all the components, master batching wherein any single master batch contains the wetting agent(s) in a larger proportion relative to the final composition, or any other compounding procedure.

A preferred method consists essentially of heating the polymer at a temperature below its decomposition temperature, incorporating the wetting agents, and mixing so as to obtain a substantially uniform plastic composition. The mixing of the wetting agents into the polymer is done by mixing it into molten polymer by commonly used techniques such as roll-milling, mixing in a Banbury type mixer, or mixing in an extruder barrel and the like. The heat history (time at which held at elevated temperature) can be shortened by mixing the surface active agent with unheated polymer particles so as to achieve substantially even distribution of the agent in the mass of polymer, thereby reducing the amount of time needed for intensive mixing at molten temperatures. After mixing the wetting agents into the thermoplastic polymer, the plastic composition can then be processed to form the fibers and filaments. In the alternative, the plastic composition can be extruded and cooled to form a solid extrudate. Conventional plastic processing equipment can be used for melting the polymer, mixing the polymer with the wetting agents and extruding the resulting plastic composition. Processing conditions, such as temperature, time, and pressure, will be obvious to those skilled in the art.

Conveniently, the wetting agents can also be added substantially simultaneously or sequentially with any other additives (colorants, dyes, and the like) which may be desired in certain instances. The wetting agents may also be preblended with other additives and the blend then added to the polymer. It is contemplated that in some instances these wetting agents should have the additional benefit of aiding the other additives to become more easily or evenly dispersed or dissolved in the polymer.

For easier batch-to-batch control of quality, another preferred method employs concentrated master batches of polymer/agent blends which are subsequently blended, as portions, to additional quantities of polymer to achieve the final desired formulation. The master batching involves preparation of one or more "packages" or compositions which are subsequently combined into a single homogeneous mixture with the organic polymer material. In the master batching procedure, the wetting agent is initially present at a greater concentration than in the final composition. The separate master batch composition is then combined or blended in proper proportions to produce a polymeric composition embodying the present invention. This master batching technique is a preferred method in that it should improve the dispersibility of the wetting agent throughout the final polymeric composition and ultimate fibers and filaments.

There is also provided a concentrate having a thermoplastic polymer, for example, polypropylene homopolymer, containing a first and/or second wetting agent. For example, two separate concentrates may be made, each containing one of the wetting agents, and the concentrates combined, or let-down, with the desired thermoplastic polymer to the desired proportion of the respective wetting agent. Alternatively, if the relative proportions of the two wetting agents is to remain constant, a single concentrate may be prepared containing the first and second wetting agents and then let-down in the desired thermoplastic polymer. The concentrate is used in forming hydrophilic, smooth fibers and nonwovens with improved "textile-like" feel and elongation. The concentrate may have the respective type of wetting agent, i.e., a first or second wetting agent, at a concentration ranging from about 0.5 to about 60 percent by weight, preferably from about 20 to about 40 percent by weight, based on the weight of the thermoplastic polymer, noting that if more than one of a first or second wetting agent is used and the two or more first or second wetting agents, respectively, are combined in a single concentrate the concentration is for the combination of the first or second wetting agents and not each first or second wetting agent individually.

The master batch, or the neat additives, may be injected into freshly prepared polymer while the polymer is still molten and after it leaves the polymerization vessel or train, and blended therewith before the molten polymer is chilled to a solid or taken to further processing. It is within the purview of the present invention to employ blends or alloys of olefin polymers, whether they be of the above described polypropylene, LDPE, LLDPE, HDPE or other olefin polymers or copolymers made using a free-radical initiator or a coordination catalyst. Polypropylene is an example of an olefin polymer made using a coordination catalyst (e.g. the well-known Ziegler or Natta catalysts or variations thereof) yet which inherently exhibits a low density compared to polyethylene.

The polymer formulations used for making the fibers or filaments of the present invention preferably contain the wetting agents in combination in the range of about 1 to about 20 percent by weight, more preferably from about 1 to about 15 percent by weight, based on the total weight of the polymer or polymers used.

In a preferred embodiment of the invention, the thermoplastic polymer is polyethylene or polypropylene. The alkoxylated alkylphenol is a nonylphenol ethoxylate having on average from about 1 to about 10 moles of ethylene oxide condensed thereon. The nonylphenol ethoxylate preferably has the formula:

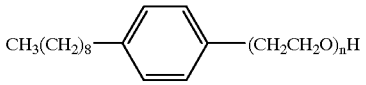

wherein n is a number from about 1 to about 10, preferably from about 2 to about 8, and more preferably from about 3 to about 6. The ethoxylated nonylphenol is preferably used in an amount from about 8 to about 12 percent by weight based on the total weight of the polymer. The second wetting agent is a water-soluble organosilicone compound, which is preferably a polyalkylene oxide modified polydimethylsiloxane (PDMS) having an average molecular weight ranging from about 3,000 to about 10,000 and has an HLB ranging from about 10 to about 17 in an amount of from about 0.5 to about 15 percent by weight of the weight of the polymer, for example, from about 2 to about 3 percent by weight.

USE OF COMPOSITION

The present invention comprises the use of a composition of a thermoplastic polymer, for example, an polyolefin, and a first and second wetting agent to form wettable fibers and filaments, especially those of fine denier, with high permanence of wettability. The neat polyolefins are hydrophobic materials and fibrous structures formed from neat polyolefin resins are not readily wet by water. In certain applications, such as those involving the dispersion of fibers in an aqueous medium and transport in or of an aqueous medium through an assembly of fibrous structures, this hydrophobic nature reduces the performance of polyolefin fibers. Imparting a lasting or use-variable surface wettability to polyolefin fibrous structures will improve and expand their use as filtration structures, transport membranes and reinforcing matrices.

The wettable fibers or filaments of the present invention are useful to form part, or comprise the major portion, of end products such as diaper inner liners, battery cell separators, filters, paper reinforcing matrix, separation membranes, moisture permeable diaphragms, and construction material reinforcing matrix. The wettable fibers or filaments of the present invention are substituted for those currently used in such end products. For example, the fibers or filaments of the present invention are useful in producing battery separators (e.g., U.S. Pat. No. 3,847,676); disposable absorbent products such as diapers, feminine care products, incontinence products and the like (e.g. U.S. Pat. No. 4,073,852 and U.S. Pat. No. 4,923,914); wiper materials (e.g., U.S. Pat. No. 4,307,143); papers (e.g. U.S. Pat. No. 4,273,892); and filter aids (e.g., U.S. Pat. No. 4,274,971), wherein the foregoing patents are hereby incorporated by reference in their entirety and modified such that the fibers or filaments of the present invention are substituted for those disclosed therein in the manufacture of the articles of manufacture identified therein. With the present disclosure, one skilled in the art would be readily able to so modify the teachings disclosed in these patents to utilize the fibers or filaments of the present invention. For example, U.S. Pat. No. 3,847,676) discloses a method of producing battery separators. The fibers or filaments thereof have an internal surfactant incorporated during melt processing of the polymer and a later applied external surfactant. By using the fibers or filaments of the present invention, the method disclosed therein would be modified such that the application of the external surfactant disclosed therein may be, and is preferably, omitted.

The present fibers are also useful as a blend component for other fibers whereby the thermoplastic properties as well as the wettability, softeners and lubricity of the fibers are found to be advantageous. The fibers or filaments can be in the form of a woven fabric, a non-woven fabric or a knitted. The fibers or filaments may also be in the form of a dispersion in an aqueous medium. The fibers or filaments may be made in a fine denier size.

The use of polyolefin fibers is a growth area in the textile and related industries. Material advantages are being recognized as economic considerations drive the replacement of more expensive synthetic and natural fibers. An area where polyolefin fibers are making inroads is the disposable diaper market. Disposable diapers currently use a nonwoven, fibrous web as the skin contact inner liner. This inner liner should join the backing to hold the diaper together, transport fluid away from the skin via a wicking mechanism and provide a comfortable skin contact surface. The materials of choice for inner liners are presently polyester and cellulose with polypropylene gaining an increasing market share. The inner liners are composed of very fine, interconnected fibers of variable lengths. Polyester inner liners wet fairly readily and wick effectively but polyester webs have a coarse feel. Cellulose wets but also absorbs and retains water. Polypropylene provides a much softer web than polyester but it wets poorly.

Linear low density polyethylene (LLDPE) fibers exhibit enhanced tactile properties such as softness compared to polypropylene and high density polyethylene. Melt blending linear low resins with the combination of wetting agents and melt spinning the blend produces wettable fibers with tactile properties superior to fibers of barefoot (neat) linear low density polyethylene resins. Webs of the wettable linear low density polyethylene fibers exhibit rapid wetting and transport of aqueous media through the fiber matrix. These fibrous structures demonstrate good performance potential and offer a means for opening new markets of olefin polymers. Wettability is a surface phenomena involving minimization of the interfacial surface energies between adjacent solid and liquid phases. In the case of water and polyolefins, wettability generally requires altering the polymer surface. This may be accomplished via a copolymer composition or by the action of auxiliary surfactants. Copolymers often detract from polyolefin material properties, add expense and make processing more difficult. Surface active agents are generally mobile species which aggregate as an interfacial compatibilizing layer on the polymer surface. The mobility of the surface layer makes it susceptible to salvation and mechanical dispersion. In other cases, where the surface active agents possess a strong affinity for the polyolefin substrate, fiber properties may deteriorate due to plasticization and/or detrimental structural rearrangements. Surfactants generally require an additional process step for application or activation and, in prior art, are often added after forming the fibrous or fabric product.

In the present invention, the wetting agents are compounded directly with the resin, in contradistinction to post-added agents. The compounded resin is fabricated by conventional processes and the wetting property is present in the product as fabricated. The resin in the present invention is easily processed and shows no detrimental change in properties. A broad range of wetting characteristics such as degree of wetting and permanence may be obtained by varying concentrations and the ratio of the first and second wetting agents.

This invention differs from the prior art by incorporating surface active agents directly into the bulk polymer resin rather than introducing a copolymer or applying a surface treatment to fabricated fibrous structures. The wetting agents are melt blended with the polymer. The permanence of wettability can be controlled through composition and concentration of the add wetting agents. The preferred blends of the present invention comprise about 80% to about 99% of the olefin polymer, the remainder being the wetting agent (or mixture of wetting agents as described in this disclosure), excluding any consideration of the weight of other additives (e.g. pigments, colorants, fillers, etc.) that may comprise a portion of the total final blend. The following examples illustrate particular embodiments of the present invention, but the invention is not limited to the particular embodiments shown.

EXAMPLES

Formulations

Formulation #1

First Wetting Agent Masterbatch

This formulation contained about 25% by weight of an ethoxylated nonylphenol having about 4 moles of ethylene oxide, about 0.35% by weight of a phosphite antioxidant (IRGAFOS 168) and about 74.65% by weight of a 12 MFR polypropylene homopolymer (Montel 6301 available from Montel U.S.A., where MFR stands for Melt Flow Rate which is determined according to ASTM Method D1238 and is in units of g/10 minutes). The ethoxylated nonylphenol additive is available under the trade name T-DET N4 from Harcros Chemicals Inc. It is an anhydrous liquid non-ionic surfactant produced by the reaction of nonyl phenol with about 4 moles of ethylene oxide per mole of the nonylphenol. At 25° C., the T-DET N4 additive is a clear liquid, having a viscosity of about 350 centistokes. This additive is a non-ionic surfactant which is insoluble in water.

Formulation #2

Second Wetting Agent Masterbatch

This formulation contained about 20% by weight of a polydimethylsiloxane (PDMS) compound, about 0.35% by weight of a phosphite antioxidant (IRGAFOS 168) and about 79.5% by weight of a 12 MFR polypropylene homopolymer (Montel 6301 available from Montel U.S.A.). The PDMS compound is a non-ionic organosilicone available from OSI Specialities, Inc. with a trade name SILWET L-7604. At 25° C., this PDMS compound is a clear liquid, having a viscosity of about 300 to 800 centistokes and is a non-ionic surfactant which is soluble in water.

Formulation #3

First Wetting Agent Masterbatch

This formulation contained about 30% by weight of a nonylphenol ethoxylate (T-DET N4) having about 4 moles of ethylene oxide per mole of the nonyl phenol, about 0.35% by weight of a phosphite antioxidant (IRGAFOS 168), about 43.65% by weight of a 35 MFR polypropylene homopolymer (Amoco Polypropylene Homopolymer Resin Grade 7956) and about 26% by weight of a 1000 MFR polypropylene homopolymer (Escorene (R) PP3456 G polypropylene available from Exxon).

Formulation #4

Second Wetting Agent Masterbatch

This formulation contained about 30% by weight of a PDMS compound (SILWET L 7604), about 0.35% by weight of a phosphite antioxidant (IRGAFOS), about 26% by weight of a 35 MFR polypropylene homopolymer (Amoco Polypropylene Homopolymer Resin Grade 7956) and about 43.65% by weight of a 1000 MFR polypropylene homopolymer (Escorene (R) PP3456 G polypropylene available from Exxon).

Formulation #5

Second Wetting Agent Masterbatch

This formulation contained about 25% by weight of a 4 mole ethoxylated version of a 1:2 ratio of stearyl and cetyl alcohol blend (Ceterath-4), about 0.25% by weight of a phosphite antioxidant (IRGAFOS 168) and about 74.75% by weight of a 12 MFR polypropylene homopolymer (Montel 6301 available from Montel U.S.A.). The ethoxylated stearyl and cetyl alcohol blend is a non-ionic surfactant which is solid at room temperature and is available under the trade name Hetoxol CS-4 from Heterene Inc.

Formulation #6

Second Wetting Agent Masterbatch

This formulation contained about 30% by weight of Ceterath-4, about 0.5% by weight of a phosphite antioxidant (IRGAFOS), about 20% by weight of a 12 MFR polypropylene homopolymer (Montel 6301 available from Montel U.S.A.) and about 49.5% by weight of a 1000 MFR polypropylene homopolymer (Escorene (R) PP3456 G polypropylene available from Exxon).

Processes

Preparation of Additive Masterbatch

1. Production Scale

A production scale co-rotating twin-screw extruder, made by Leistriz Corporation, Summerville, N.J. (50 mm diameter screws, L/D of 36 to 1) was used to prepare Formulations #1 through Formulation #4. This equipment had turbine mixing elements to provide good mixing of the polymer melt and the surfactant additive(s). The temperature profile and screw design were chosen in a manner not to degrade either the additive or the polymer. The extruder had 11 heating zones and the temperature profile in was about as follows: 190° C., 204° C., 215° C., 215° C., 215° C., 215° C., 204° C., 204° C., 190° C., 190° C. and 190° C., respectively. The screw speed was set at about 400 rpm and the melt temperature was set at about 190° C. The liquid surfactant was added at a predetermined rate (varies according to the total rate of production) using a liquid injection device from Zenith Co. This liquid injection device was equipped with a positive displacement device also known as a gear pump, a control for regulating the speed of gears and thereby the amount of liquid per unit time, a temperature monitor and regulator of the liquid, and an insulated hose that connects the reservoir containing the liquid surfactant additive to the extruder port. There were two ports for entry of the liquid into the extruder. Using the port nearest to the feed section allowed more time for incorporation of the liquid surfactant additive into the thermoplastic polymer. Depending on the temperature, stability and viscosity of the liquid surfactant additive, the final throughput rate was chosen to obtain an optimum blend of the liquid surfactant additive and the polymer.

2. Lab Scale

A lab scale co-rotating twin screw extruder, made by Leistriz Corporation, Summerville, N.J. (34 mm diameter screws, having an L/D of 27 to 1) was used to prepare Formulation #5 and Formulation #6. Unlike the production scale equipment, this extruder had eight (8) heating zones with the temperature profile from zone 1 through 8 being about: 200° C., 200° C., 200° C., 200° C., 185° C., 165° C., 200° C. and 200° C., respectively. The screw speed was set at about 150 rpm and the melt temperature set at about 200° C. The liquid injection pump used was a miniature version of the production scale version used above and was also from Zenith Co. with appropriate regulators.

The concentrates or master batches made using the production and lab scale extruders were pressed out into very thin films (about three (3) mils thick) using a Carver press and then compared against an internal standard for a determination of the final level of active surfactant in the polymer. The temperature of the press was maintained at about 200° C. and a constant pressure of about 4,000 psi was applied for about one (1) minute. The press-out was then cooled under the same pressure for about the same time. An FTIR from Nicolet, Model 5DXC was used to determine the amount of additive in the polypropylene masterbatch. The absorbance mode was used for the quantitative determination of the surfactant additives in the concentrates. In these formulations (master batches), the modified polysiloxane used was SILWET L 7604 which is end-capped with hydrogen, thereby forming a hydroxyl group. The ethoxylated nonylphenol also has a hydroxyl group. The presence of —OH groups can be seen at around 3400 $cm^{-1}$ wavelength and can be used to determine the amount of each additive in the respective materbatch composition.

Example 1

Fiber Samples

The Let-Down-Ratio percent (% LDR) refers to the percent by weight of the concentrates containing the surfactant additive(s) added to the thermoplastic polymer to make fibers, films, etc., to yield a certain final level of the additive(s) in the finished article. The concentrates made by extrusion compounding using different formulations were dry blended homogeneously with a polypropylene resin (35 MFR; Amoco Polypropylene Homopolymer Resin Grade 7956) for fiber spinning. The fiber spinning was performed on a Hills Research & Development Line (Hills Line) using the concentrates, that is Formulations #1 through #6, individually or in combination, to produce multifilaments with 10 denier per filament (dpf).

The Hills Line had a single screw with three heat zones, a spin pump and a 41 holes (round) spinnerette. The temperature profile for the three heat zones were set at about 200° C., 210° C. and 220° C., respectively. The melt temperature was kept at about 210° C. The temperature of the feed godet was set at about 25° C., the draw godet at about 60° C. and the relax godet at about 65° C. The godet speed was set at about 250 rpm for the feed, about 400 rpm for draw and about 410 rpm for the relax rolls. The outlet pressure was set at about 600 psi. The spin finish application was not performed during spinning as this may change the surface characteristics.

Formulation #1 was let down at 30% LDR in a 35 MFR polypropylene homopolymer.

Formulation #2 was let down at 30% LDR in a 35 MFR polypropylene homopolymer.

Formulation #2 was let down at 10% LDR in a 35 MFR polypropylene homopolymer.

Formulation #5 was let down at 10% LDR in a 35 MFR polypropylene homopolymer.

As an embodiment of the present invention to form filaments with synergistic properties, Formulation #1 was let down at 30% LDR and Formulation #2 was let down at 5% LDR in a 35 MFR polypropylene homopolymer.

As another embodiment of the present invention to form filaments with synergistic properties, Formulation #1 was let down at 30% LDR and Formulation #5 was let down at 5% LDR in a 35 MFR polypropylene homopolymer.

The objective of this trial was to determine the spinnability of the wetting agent master batches once let down and evaluate the wettability and wicking properties of the resulting fibers. All the samples that were spun had very good wettability with water. The multifilaments were wound on a card-wrap in a convenient form. This provided a flat surface for the wettability test. Wettability tests were performed placing a drop of deionized water which was slightly colored with a red food dye to clearly see the wettability of the fibers and timed to see how long it would take for wet-out to occur, i.e., wet-out time in seconds. Wicking was also tested using a column of fibers dipped in the colored deionized water to see how high the water rose in the column of fibers against gravity, i.e., wicking distance in millimeters. Portions of the fibers were tested for the amount of the surface active agent(s) using FTIR.

Example 2

Melt Blown Nonwoven Samples with Wetting Agents

The efficacy of the wetting agent of the present invention was extended to melt blown nonwovens. In this example, the melt blowing equipment was made by Davis-Standard of Pawcatuck, Conn., USA. A 50.8 cm wide melt blown die was used for producing hydrophilic melt blown nonwovens. The die had 501 holes of 400 microns diameter each. The average diameter of the fiber was about 2 microns. The melt blowing equipment had a single screw with a screw diameter of 50.8 mm and L/D of 30 to 1, and had four (4) heating zones having a temperature profile of about: 177° C., 232° C., 232° C. and 232° C., respectively. The die temperature was set at about 232° C. and the air temperature at about 218° C. The die-to-collector distance or the cooling length was set at about 30 cm. The throughput rate was about 12 Kg per hour. The collector speed was about 24 meters per minute. The fabric samples produced had a weight of approximately 20 grams per square meter.

The different melt blown fabrics produced using masterbatch samples of Formulations #3, #4 and #6, which were mixed at different levels, that is let-down, with a 1000 MFR polypropylene homopolymer (Escorene (R) PP3456 G polypropylene available from Exxon) to produce the hydrophilic melt blown nonwovens. The let-down of the masterbatch containing Formulation #3 preferably ranges from about 10 to about 50 percent by weight and that of Formulation #4 preferably ranges from about 2 to about 15 percent by weight. For the trial that was performed, Formulation #1 was used at 30% LDR alone and in conjunction at the same level with Formulation #4 which was used at 6.7% LDR.

The melt blown samples produced were evaluated for wettability and wicking characteristics and the results are shown below:

| Sample ID. | Wet-Out Time (Sec) | Wicking Distance (mm) |
|---|---|---|
| 30% LDR of Formulation #3 | Instant | 25 |
| 30% LDR of Formulation #3 +6.7% LDR of Formulation #4 | Instant | 30 |

The synergistic effect of wetting agent of the present invention, which combines a first wetting agent which was a water-insoluble, nonionic alkoxylated alkylphenol and a second wetting agent which was a water-soluble nonionic PDMS compound, is demonstrated in the table above to show an increase in wicking distance without adversely affecting wet-out time.

Example 3

Spunbond Samples

Spunbond samples are used in top sheet applications for diapers. The polypropylene filaments after the spinning stage are bonded to each other by thermal means using two heated calender rollers under constant pressure. The fiber diameter is usually between 15 to 25 microns on an average and is a function of the type of polymer, viscosity of the polymer, process conditions such as the temperature of the polymer, air pressure and temperature, orientation, etc.

The spunbond samples were produced using a Reicofil brand spunbonding equipment made by Reifenhauser, Troisdorf, Germany. This equipment had a one (1) meter wide line, five (5) extruder zones and an L/D of 32 to 1. The temperature of the five (5) extruder zones were set at about: 195° C., 200° C., 205° C., 210° C. and 210° C., respectively. The die temperature was set at about 220° C. and the melt temperature at about 224° C. The screw speed was set at about 106 rpm. The spin belt speed and the bonder speed were kept at about 58 meters per minute. The winder speed was kept at about 65.8 meters per minute. The upper calender roll temperature was set at about 136° C. and the lower roll at about 134° C. The calender pressure was about 274 pounds per linear inch. The bonding area was about 17 percent. The throughput rate was kept at about 78 Kg per hour. The average fiber diameter was about twenty (20) microns. The fabric width was about 1 meter. The final fabric weight was approximately 50 grams per square meter.

For sample SB-1, Formulation #1 was let-down at 18% LDR in the spunbonding process mixed with polypropylene homopolymer resin of 35 MFR (Amoco Polypropylene Homopolymer Resin Grade 7956) to produce spunbonded nonwovens.

For sample SB-2 (according to the present invention), Formulation #1 was let-down at 18% LDR and Formulation #2 at 2% LDR mixed with polypropylene homopolymer resin of 35 MFR (Amoco Polypropylene Homopolymer Resin Grade 7956) to produce spunbonded nonwovens.

For sample SB-3 (according to the present invention), Formulation #1 was let-down at 14% LDR and Formulation #5 at 8% LDR mixed with polypropylene homopolymer resin of 35 MFR (Amoco Polypropylene Homopolymer Resin Grade 7956) to produce spunbonded nonwovens.

All the fabrics showed hydrophilicity. However, the fabrics made from SB-2 and SB-3 had superior processability and hydrophilicity over SB-1, with SB-3 being the best of these three. The table below shows the superior hydrophilicity of SB-3 over SB-1 and SB-2 and of SB-2 over SB-1.

| Sample ID. | We-Out Time (Seconds) | Wicking Distance (mm) |
|---|---|---|
| SB-1 | 60 | 0 |
| SB-2 | 3 | 50 |
| SB-3 | Instant | 50 |

What is claimed is:

1. Wettable fibers or filaments prepared from a composition comprising:

a thermoplastic polymer having incorporated therein
a first wetting agent and
a second wetting agent, wherein the thermoplastic polymer is selected from the group consisting of olefin polymers, wherein the first wetting agent is at least one water-insoluble nonionic alkoxylated alkyl phenol, and wherein the second wetting agent is at least one compound selected from the group consisting of an alkoxylated fatty alcohol and a water-soluble, nonionic, non-hydrolyzable polyoxyalkylene-modified organosilicone polymer.

2. The fibers or filaments of claim 1, wherein the first wetting agent is an ethoxylated nonylphenol having about 4 moles of ethylene oxide.

3. The fibers or filaments of claim 1, wherein the first wetting agent is an ethoxylated alkylphenol having the formula:

$$R—C_6H_4(OCH_2CH_2)_nOH$$

wherein R is an alkyl group having 8 to 22 carbon atoms and n is a number ranging from about 1 to about 10.

4. The fibers or filaments of claim 3, wherein R is a nonyl group.

5. The fibers or filaments of claim 3, wherein the first wetting agent is an ethoxylated alkylphenol having the formula:

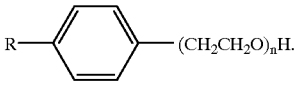

6. The fibers or filaments of claim 1, wherein the second wetting agent is a water-soluble, nonionic, non-hydrolyzable polyoxyalkylene-modified organosilicone polymer.

7. The fibers or filaments of claim 6, wherein the water-soluble, nonionic, non-hydrolyzable polyoxyalkylene-modified organosilicone polymer has the formula:

$$(R_1)_3SiO—(—Si(R^1)_2—O—)_X—(—Si(R^1)(R^2)—O—)_Y—Si—(R^1)_3$$

wherein each $R^1$ is independently monovalent alkyl group having from 1 to about 4 carbon atoms, preferably a methyl group;

$R^2$ is a group having the formula $—(CH_2)_3—O—(EO)_M(PO)_NR^3$, wherein EO is an ethyleneoxy group, PO is a 1,2-propyleneoxy group, and $R^3$ is hydrogen or an alkyl having from 1 to about 4 carbon atoms; and M, X and Y are numbers which have a value of at least 1, and N is a number which may be 0 or greater.

8. The fibers or filaments of claim 1, wherein the thermoplastic polymer is an ethylenically saturated olefin polymer.

9. The fibers or filaments of claim 8, wherein the thermoplastic polymer is polypropylene.

10. The fibers or filaments of claim 8, wherein the thermoplastic polymer is LLDPE.

11. The fibers or filaments of claim 8, wherein the thermoplastic polymer is LDPE.

12. The fibers or filaments of claim 8, wherein the thermoplastic polymer is HDPE.

13. The fibers or filaments of claim 8, wherein the thermoplastic polymer is a copolymer.

14. The fibers or filaments of claim 1, wherein the second wetting agent is a water-soluble alkoxylated fatty alcohol.

15. The fibers or filaments of claim 14, wherein the alkoxylated fatty alcohol is an ethoxylated fatty alcohol having the formula $R—(CH_2CH_2O)_PH$, wherein R is an alkyl group having from about 8 to about 20 carbon atoms and wherein P is a number ranging from about 1 to about 100, more preferably about 2 to about 10.

16. The fibers or filaments of claim 15, wherein the ethoxylated alcohol is a combination of an ethoxylated cetyl alcohol and an ethoxylated stearyl alcohol in a weight ratio of from about 3:1 to about 1:3.

17. The fibers or filaments of claim 1, wherein the first and second wetting agents are present in an amount of about 1 to about 20 percent by weight.

18. The fibers or filaments of claim 17, wherein the first wetting agent is present in an amount of about 8 to about 12 percent by weight and the second wetting agent is present in an amount of about 2 to 3 percent by weight.

19. The fibers or filaments of claim 1, wherein the fibers or filaments are in the form of a woven fabric.

20. The fibers or filaments of claim 1, wherein the fibers or filaments are in the form of a non-woven fabric.

21. The fibers or filaments of claim 1, wherein the fibers or filaments are in the form of a knitted fabric.

22. The fibers or filaments of claim 1, when combined with other fibers, thereby imparting thermoplasticity, softness and wettability properties to the whole.

23. The fibers or filaments of claim 1, when employed as a wettable portion of products selected from the group consisting of diaper products, battery cell separators, filters, papers, membranes, moisture permeable diaphragms and construction materials.

24. The fibers or filaments of claim 1 in the form of a dispersion in an aqueous medium.

25. The fibers or filaments of claim 1 of a fine denier size.

26. The fibers or filaments of claim 25 having a denier from about 0.5 to about 10.

* * * * *

UNITED STATES PATENT AND TRADEMARK OFFICE

CERTIFICATE OF CORRECTION

PATENT NO. : 6,146,757

DATED : November 14, 2000

INVENTOR(S) : Mor et al.

It is certified that error appears in the above-indentified patent and that said Letters Patent is hereby corrected as shown below:

Column 8, line 23, change "all" to --alkyl--.

Column 14, line 9, change "salvation" to --solvation--.

Signed and Sealed this

Twenty-second Day of May, 2001

Nicholas P. Godici

*Attest:*

NICHOLAS P. GODICI

*Attesting Officer*

*Acting Director of the United States Patent and Trademark Office*